US011141848B2

(12) United States Patent
Stoof et al.

(10) Patent No.: US 11,141,848 B2
(45) Date of Patent: Oct. 12, 2021

(54) AUTOMATIC PNEUMATIC FASTENER DRIVING TOOL ADAPTER

(71) Applicant: Kyocera Senco Industrial Tools, Inc., Cincinnati, OH (US)

(72) Inventors: Johan Johannes Stoof, Baambrugge (NL); Johannes Antonius Rudolf Grouve, Harderwijk (NL)

(73) Assignee: Kyocera Senco Industrial Tools, Inc., Cincinnati, OH (US)

( * ) Notice: Subject to any disclaimer, the term of this patent is extended or adjusted under 35 U.S.C. 154(b) by 295 days.

(21) Appl. No.: 15/709,563

(22) Filed: Sep. 20, 2017

(65) Prior Publication Data

US 2019/0084139 A1 Mar. 21, 2019

(51) Int. Cl.

| | |
|---|---|
| ***B25C 7/00*** | (2006.01) |
| ***B25C 5/13*** | (2006.01) |
| ***B25C 1/04*** | (2006.01) |

(52) U.S. Cl.

CPC ..... *B25C 7/00* (2013.01); *B25C 1/04* (2013.01); *B25C 5/13* (2013.01)

(58) Field of Classification Search

CPC .. B25C 7/00; B25C 5/13; B25C 1/041; B25C 1/043; B25C 1/046; F15B 11/15; F15B 15/204; F15B 13/0426; F16K 31/1221; F16K 11/0712; F16K 11/0716; F16K 11/07; F01L 25/06–066; F01L 25/063; F01L 21/04; Y10T 137/86582

USPC ..... 227/130; 137/625.6, 625.69

See application file for complete search history.

(56) References Cited

U.S. PATENT DOCUMENTS 2,020,773 A * 11/1935 Ernst ..... F16K 31/122 251/63
2,445,674 A * 7/1948 Kendall ..... B25C 1/04 227/112
2,802,451 A * 8/1957 Chellis ..... B25C 1/04 91/394
2,807,021 A * 9/1957 Chellis ..... B25C 1/04 227/7
3,278,103 A * 10/1966 Juilfs ..... B25C 1/041 227/130
3,278,104 A * 10/1966 Becht ..... B25C 1/041 227/130
3,434,393 A * 3/1969 Cairatti ..... B25C 1/041 91/417 A (Continued)

FOREIGN PATENT DOCUMENTS

DE 3341980 A1 * 7/1985 ..... B25C 1/008
GB 1057287 A * 2/1967 ..... B25C 1/041

OTHER PUBLICATIONS

International Search Report, PCT/US18/51471, 8 pages (dated Dec. 7, 2018).

*Primary Examiner* — Joshua G Kotis
(74) *Attorney, Agent, or Firm* — Frederick H. Gribbell; Russell F. Gribbell

(57) ABSTRACT

An adapter converts a fastener driving tool into an automatic (multiple shots per second) pneumatic fastener driving tool. The adapter is mounted to the top of the frame body of a pneumatic fastener driving tool, in which the adapter has a control valve that automatically moves to direct pressurized air to different passageways in the tool body in a repetitive cyclic manner. The speed of actuation can be adjusted by the user.

18 Claims, 9 Drawing Sheets

(56) References Cited

U.S. PATENT DOCUMENTS 3,504,840 A * 4/1970 Wandel ..... B25C 1/005 227/130
3,561,324 A * 2/1971 Obergfell ..... B25C 1/041 91/252
3,572,362 A * 3/1971 Pauliukonis ..... F15B 11/15 137/102
3,580,287 A * 5/1971 McLaughlin ..... F16K 27/048 137/625.69
3,674,041 A * 7/1972 Beals ..... F15B 11/15 137/1
3,680,577 A * 8/1972 McGeachy ..... F15B 20/004 137/625.6
3,773,083 A * 11/1973 Hague ..... F15B 13/042 137/625.69
3,846,049 A * 11/1974 Douglas ..... F01L 25/063 417/404
3,850,079 A * 11/1974 Fehrs ..... B25C 1/044 91/308
3,895,562 A * 7/1975 El Guindy ..... B25C 1/041 91/308
3,905,535 A * 9/1975 Novak ..... B25C 1/008 227/120
4,384,668 A * 5/1983 Tutomu ..... B25C 1/041 173/169
4,436,237 A 3/1984 Vornberger et al.
4,510,973 A * 4/1985 Balaskas ..... F15B 13/042 137/596.18
4,846,045 A * 7/1989 Grach ..... F01L 25/063 91/306
5,349,895 A * 9/1994 DiCarlo ..... F01B 25/06 60/379
5,465,646 A * 11/1995 DiCarlo ..... F01L 21/04 91/308
5,645,208 A * 7/1997 Haytayan ..... B25C 1/008 227/130
5,873,510 A * 2/1999 Hirai ..... B25C 1/042 227/130
5,983,638 A * 11/1999 Achten ..... F01L 25/06 251/30.02
6,494,432 B1 * 12/2002 Sticht ..... F16K 7/16 251/11
7,431,043 B2 * 10/2008 Xiang ..... F16H 61/0021 137/118.02
7,784,560 B2 8/2010 Mina et al.
2012/0223120 A1 9/2012 Mina
2016/0151900 A1 6/2016 Wu et al.
2016/0319812 A1 11/2016 Krech et al.
2016/0327168 A1 * 11/2016 Hatano ..... F16K 31/124
2018/0348797 A1 * 12/2018 Kamiya ..... F15B 21/087

* cited by examiner

AUTOMATIC PNEUMATIC FASTENER DRIVING TOOL ADAPTER

CROSS-REFERENCE TO RELATED APPLICATIONS

None.

TECHNICAL FIELD

The technology disclosed herein relates generally to pneumatic fastener driving tools and is particularly directed to an adapter that converts a fastener driving tool into an automatic (multiple shots per second) pneumatic fastener driving tool. Embodiments are specifically disclosed as an adapter that is mounted to the frame body of a pneumatic fastener driving tool, in which the adapter has a control valve that automatically moves to direct pressurized air to different passageways in the tool body in a repetitive cyclic manner. The speed of actuation can be adjusted by the user.

STATEMENT REGARDING FEDERALLY SPONSORED RESEARCH OR DEVELOPMENT

None.

BACKGROUND

Certain pneumatically-operated staplers are used for heavy duty fastener application, such as sheathing, furniture framing, roof decking, subflooring, pallets, and the like. An example of such a heavy-duty wire stapler is a Senco Model No. SHS51XP-N, which can drive staples that are at least 50 mm in length. This tool is a single-shot device.

SUMMARY

It is an advantage to provide an adapter that is mounted on a fastener driving tool that allows that tool to operate faster, and in a cyclic manner, by providing a control valve that moves in a repetitive cycle to direct pressurized gas, such as compressed air, into appropriate passageways in the tool body.

It is an advantage to provide an adapter that is mounted on a fastener driving tool that allows that tool to operate faster, and in an automatic firing cycle, by providing a control valve that moves in a repetitive cycle to direct pressurized gas (such as compressed air) into appropriate passageways in the tool body in which the firing rate of the tool can be adjusted by a user.

Additional advantages and other novel features will be set forth in part in the description that follows and in part will become apparent to those skilled in the art upon examination of the following or may be learned with the practice of the technology disclosed herein.

To achieve the foregoing and other advantages, and in accordance with one aspect, an adapter for use with a pneumatically-operated fastener driving tool is provided, which comprises: (a) a housing having a plurality of passageways to allow gas (such as air) to flow therethrough, including a speed control passageway, a first trigger control passageway, and a first firing valve control passageway; (b) a movable control valve that is movable within an opening in the housing; (c) at least two of the plurality of passageways being in fluidic communication with the control valve, and extending to predetermined positions along a mating surface of the housing; (d) in an initial operating state, the control valve occupies a first position which allows gas (such as air) to flow between the first trigger control passageway and the first firing valve control passageway, but prevents gas (such as air) from flowing in the speed control passageway; (e) in a second operating state, the control valve allows gas (such as air) to flow in the speed control passageway, while gas (such as air) does not flow between the first trigger control passageway and the first firing valve control passageway; (f) in a third operating state, the gas (or air) flow in the speed control passageway moves the control valve to a second position which prevents gas (such as air) from flowing between the first trigger control passageway and the first firing valve control passageway, but allows gas (such as air) to flow between a pressurized gas (or air) source and the first firing valve control passageway; and (g) in a fourth operating state, a spring forces the control valve to move back to the first position, which again allows gas (such as air) to flow between the first trigger control passageway and the first firing valve control passageway.

In accordance with another aspect, a combination adapter and pneumatically-operated fastener driving tool is provided, which comprises: (a) a pneumatically-operated fastener driving tool comprising: a user-actuated trigger; a firing valve that, when actuated, drives a fastener from the tool and into a workpiece; a second trigger control passageway, and a second firing valve control passageway; the second trigger control passageway being used to contain a trigger gas (or air) flow signal that changes state when the trigger of the tool is actuated by a user; and the second firing valve control passageway being used to contain a firing gas (or air) flow signal that changes state when the firing valve is to be actuated; (b) a adapter comprising: a housing having a plurality of passageways to allow gas (or air) flows to pass therethrough, including a speed control passageway, a first trigger control passageway, and a first firing valve control passageway; a movable control valve that is movable within an opening in the housing; and at least two of the plurality of passageways being in communication with the control valve, and extending to predetermined positions along a mating surface of the housing; (c) the mating surface of the housing is mounted adjacent to the pneumatically-operated fastener driving tool, such that the second trigger control passageway mates to the predetermined position of the first trigger control passageway along the mating surface of the adapter; and the second firing valve control passageway mates to the predetermined position of the first firing valve control passageway along the mating surface of the adapter; (d) in an initial operating state in which the trigger is not actuated, the control valve occupies a first position which allows gas (such as air) to flow between the first trigger control passageway and the first firing valve control passageway, but prevents gas (such as air) from flowing in the speed control passageway; (e) in a second operating state in which the trigger is actuated by a user, the control valve allows gas (such as air) to flow in the speed control passageway, while gas (such as air) does not flow between the first trigger control passageway and the first firing valve control passageway; (f) in a third operating state in which the trigger remains actuated, the gas (or air) flow in the speed control passageway moves the control valve to a second position which prevents gas (such as air) from flowing between the first trigger control passageway and the first firing valve control passageway, but allows gas (such as air) to flow between a pressurized gas (or air) source and the first firing valve control passageway; and (g) in a fourth operating state in which the trigger remains actuated, a spring forces the control valve to move back to the first position, which again allows gas (such as air) to flow between the first trigger control passageway and the first firing valve control passageway.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

DETAILED DESCRIPTION

Figure 1:
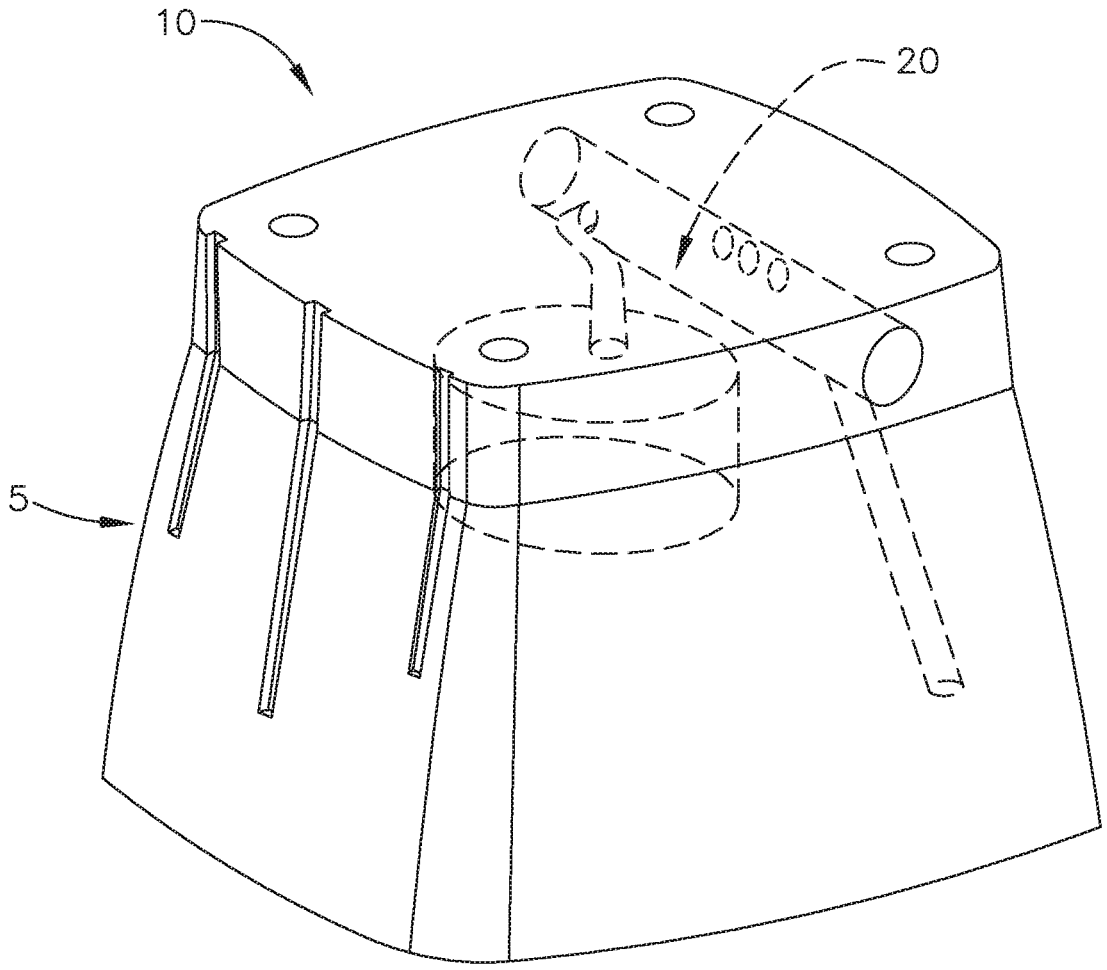
FIG. 1 is a perspective view of a top (rear) portion of a pneumatic fastener driving tool with an adapter mounted thereto, as constructed according to the principles of the technology disclosed herein.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The terms "first" and "second" preceding an element name, e.g., first inlet, second inlet, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

Referring now to FIG. 1, an adapter, generally designated by the reference numeral 10, is mounted to the top (or rear) of a conventional fastener driving tool 5. The adapter 10 includes a control valve 20, which converts the "single shot" fastener driving tool 5 into a "multiple shot" automatic fastener driving tool. To achieve this conversion, the end cap portion (not shown) of the conventional fastener driving tool 5 is removed, and the adapter 10 replaces that end cap portion.

There are air passageways in the conventional fastener driving tool 5 that match up to air passageways in the adapter, which will be illustrated in other views, and discussed below. In this illustrated embodiment, the conventional fastener driving tool 5 is a Senco Model No. SHS51XP-N heavy-duty wire stapler. Of course, other models of single-shot fastener driving tools could also be used with this inventive adapter.

Figure 2:
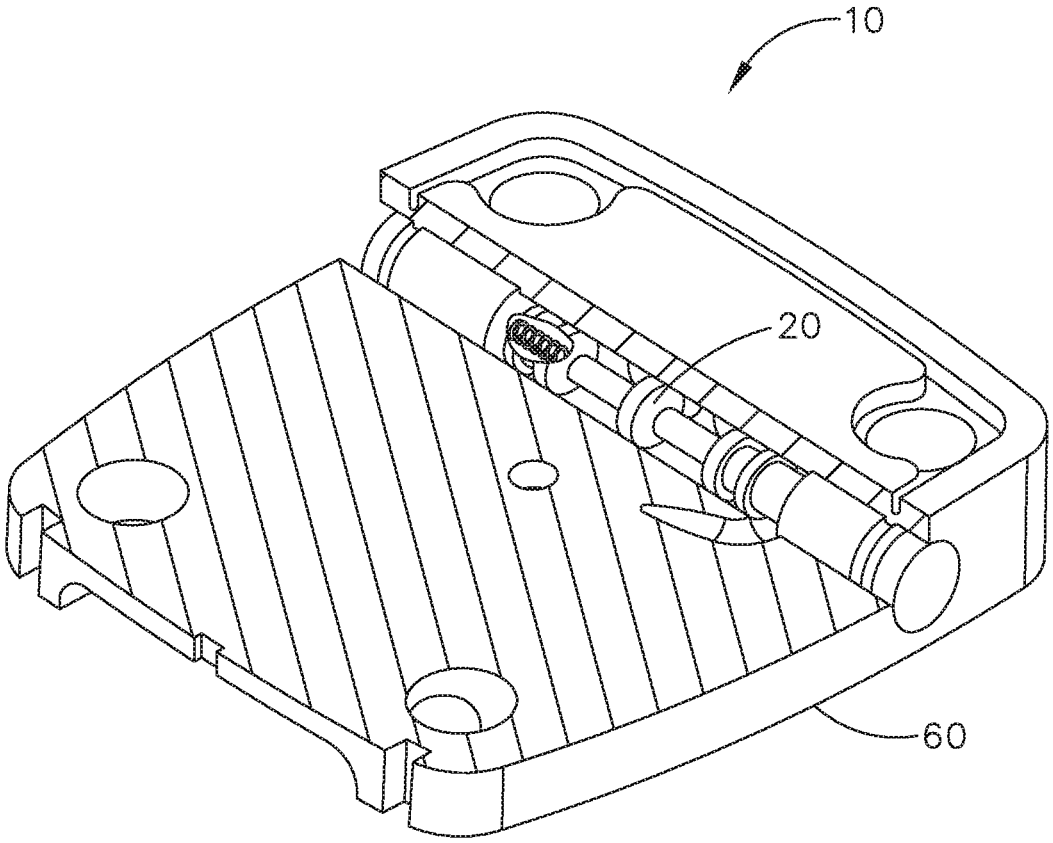
FIG. 2 is a perspective view in partial cutaway of the adapter of FIG. 1, showing details of a control valve contained therewithin.

Referring now to FIG. 2, a partial cutaway of the adapter 10 is illustrated, showing details of the control valve 20. A pair of "distance bushings," and a compression spring are also illustrated in FIG. 2, as discussed below in greater detail.

Figure 3:
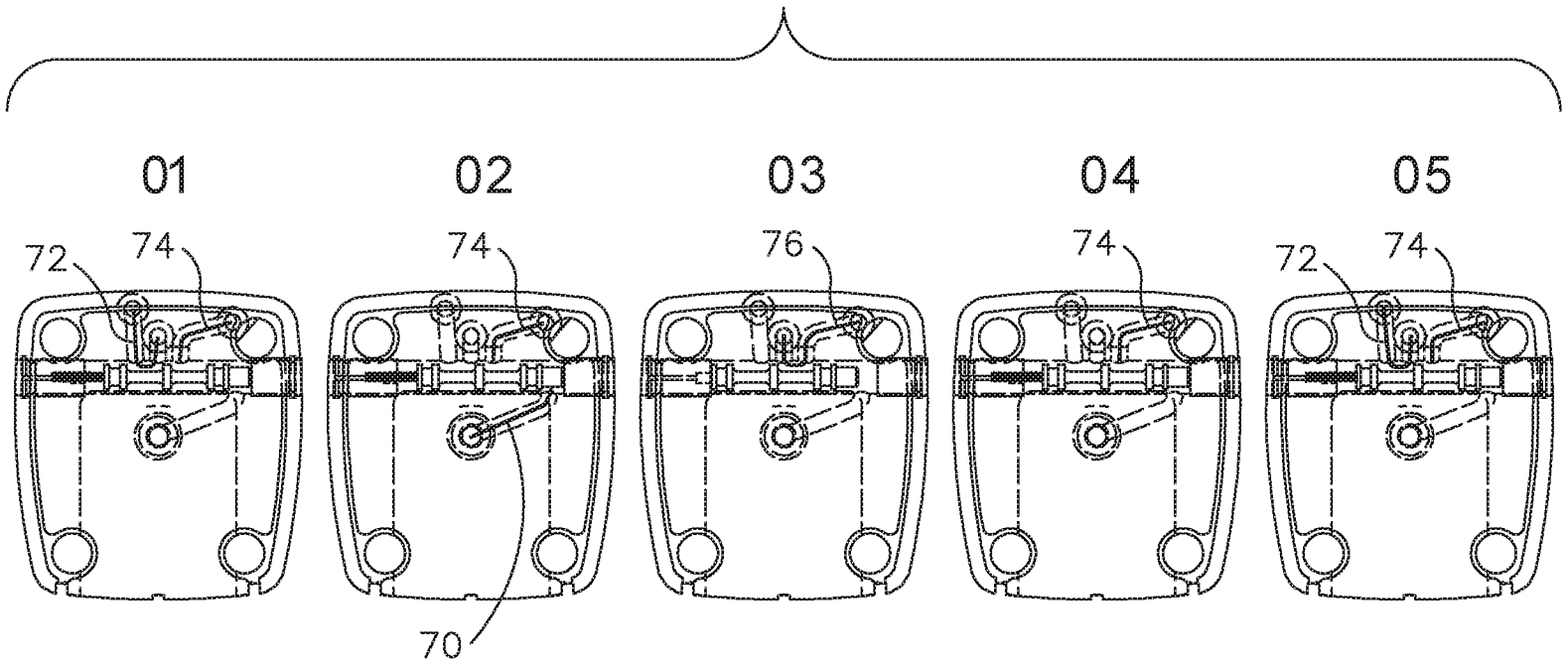
FIG. 3 is a schematic view of the adapter of FIG. 1, showing several different states of operation that make this adapter function as an automatic tool.

Referring now to FIG. 3, several views are provided showing the various stages of operation of the control valve 20 within the adapter 10. As the control valve moves to different positions within its cylindrical sleeve, different air flow patterns are enabled which allow the overall tool (i.e., the combination of the conventional tool 5 and the adapter 10) to operate in an automatic fire mode. Each of these states is illustrated in greater detail in FIGS. 4-7, which will now be described, before coming back to this FIG. 3.

Figure 4:
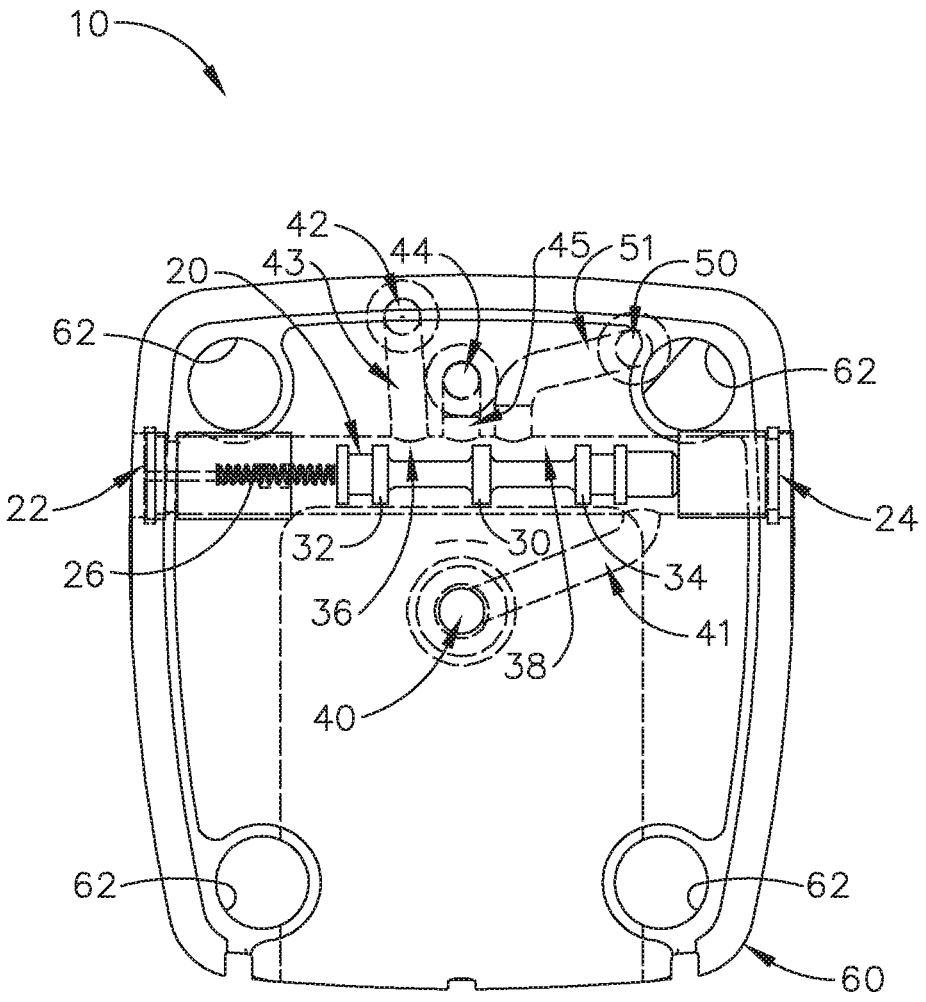
FIG. 4 is a top view of the adapter of FIG. 1, showing details of the control valve and the air passageways.

Referring now to FIG. 4, various portions of the control valve 20 are seen, including a center land 30, a left land 32, and a right land 34. Within the sleeve's cylindrical volume is a left air passageway 36 and a right air passageway 38. Adjacent to the control valve is a compression spring 26, and a pair of distance bushings 22 and 24. It should be noted that the cross-sectional shape of the control valve 20 (and its corresponding sleeve) does not necessarily have to be circular; however, that shape is a standard design in the technical field of fluidics for such valves and their internal openings (or sleeves).

A speed control air passageway (into the tool body) is indicated at reference numeral 40; a trigger air passageway (into the tool body) is indicated at reference numeral 42, and a firing valve air relief passageway (into the tool body) is indicated at reference numeral 44. A constant source of air pressure is available (from the tool body) at the reference numeral 50. Air passageways within the adapter itself exist at 41, 43, 45, and 51, in which 41 is a "speed control" air passageway, 43 is a "trigger air" passageway, 45 is a "firing valve air relief passageway," and 51 is a passageway for the constant air supply. These passageways 41, 43, 45, and 51 are sized and shaped to line up to the existing air passageways in the body of the conventional pneumatic tool 5, at the physical interface between the tool 5 and the adapter 10.

It will be understood that the phrase "air passageway" is not literally limited to transporting atmospheric "air." Any appropriate gas can be used in such tools, including carbon dioxide or nitrogen, for example. In this description, the word "air" is used merely as a convention; in the technical field of pneumatic fastener driving tools, such tools are often called "air tools," even though it is common knowledge that, for some tools, a bottle of compressed carbon dioxide gas is the actual pressurized substance that allows a specific type of tool to operate. Of course, compressed air is a likely gas for the new technology that is disclosed herein.

FIG. 4 also illustrates certain other features of the adapter 10. A "control plate" (or housing) 60 provides the outer surface of the adapter. There are several mounting holes 62 in this control plate 60, which are used to hold the adapter 10 to the tool body, using mounting screws, in most designs.

Figure 5:
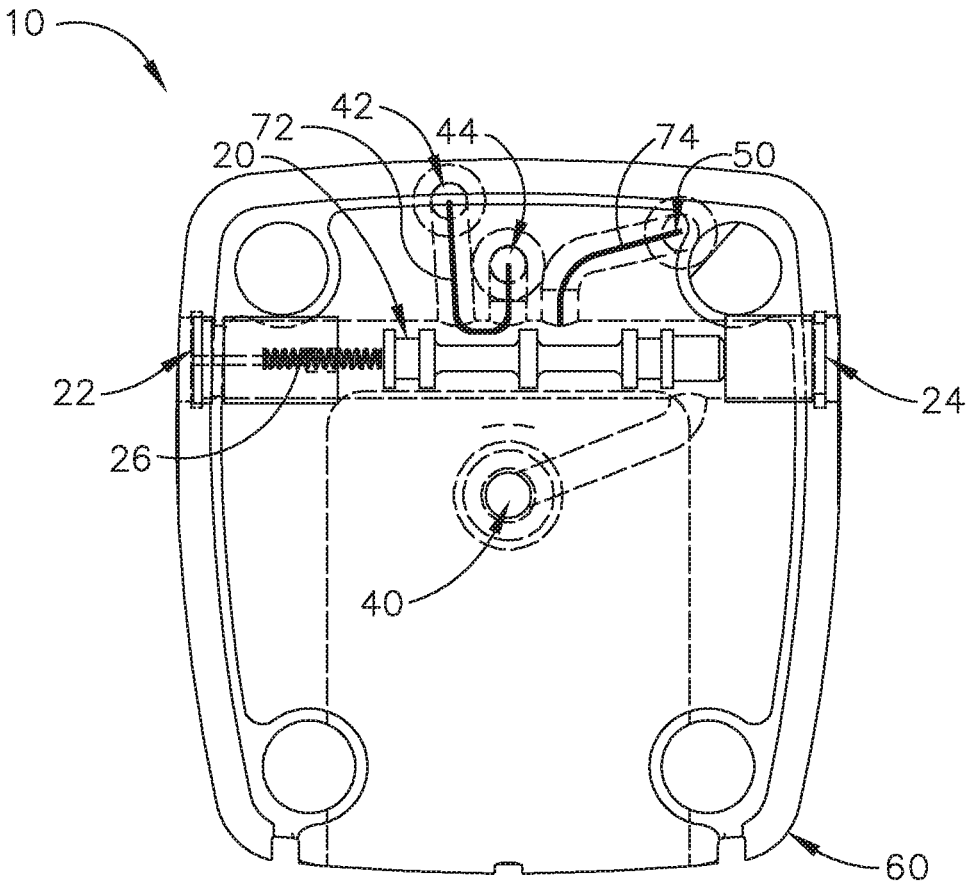
FIG. 5 is a top view of the adapter of FIG. 1, showing a first, initial operating state before the tool's trigger is actuated.

Referring now to FIG. 5, the initial state (or "first" position) of operation is illustrated, in which the trigger of the tool is not activated. In the initial state, the trigger air will flow through the control valve 20 and will press the firing valve downwards; therefore, the firing valve (not shown) will be closed. The control valve 20 is positioned to the right (in this view), in which the spring 26 is not being compressed. In that first position, the center land 30 is positioned such that the left air passageway 36 is open to both the trigger air passageway 43 and the firing valve air relief passageway 45, thereby allowing an air flow therethrough, which is referred to as the "trigger air flow path" 72.

In this state, the trigger air flow path 72 includes the air passageways 42 and 44 into the main tool body, the air passageways 43 and 45 in the adapter, and the left air passageway 36. Thus the trigger air (at 42) will flow through the control valve 20 and will press the firing valve downwards (via the firing valve air relief passageway 44); therefore, the firing valve (not shown) will be closed.

Figure 6:
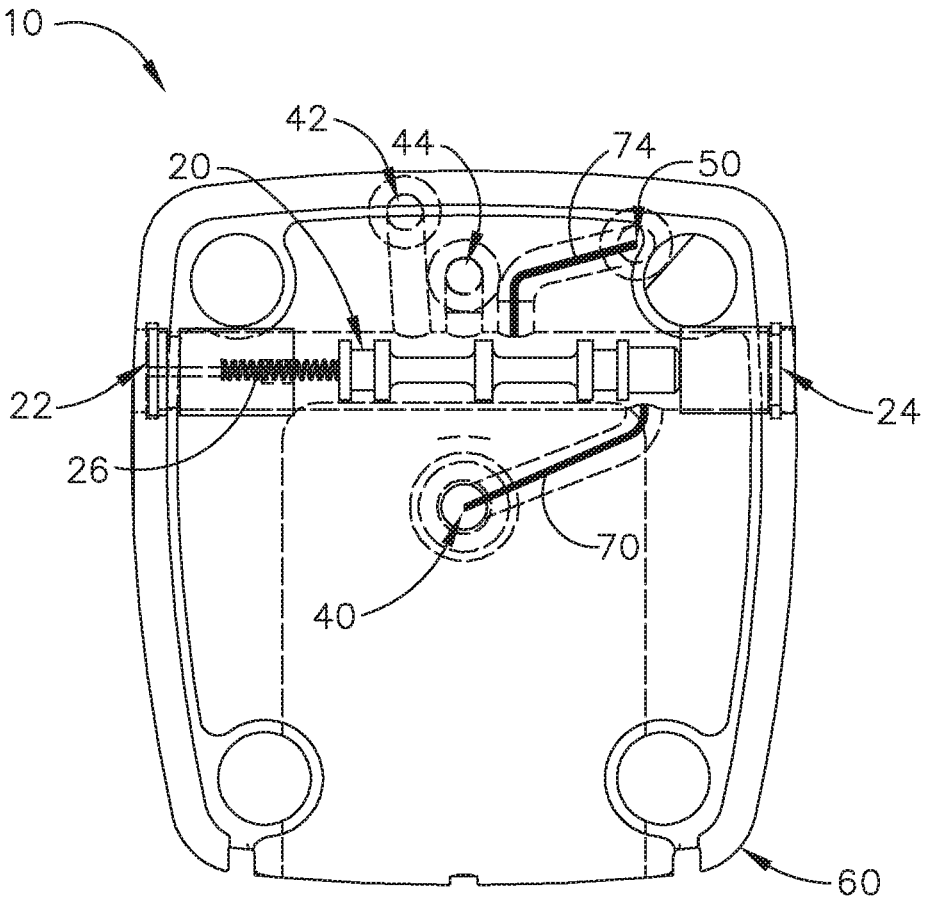
FIG. 6 is a top view of the adapter of FIG. 1, showing a second operating state after the tool's trigger has been actuated, and the firing valve opens to drive a fastener.

Referring now to FIG. 6, the next state of operation is illustrated in which the trigger (not shown) of the main tool is activated. Pressurized air will then flow through the control valve onto the firing valve and is released by the trigger. The firing valve will go up and will be in firing position, and actuates to drive a fastener. There will be air flowing through the speed control air passageway 40; this is referred to as the "speed control air flow path" 70.

Figure 7:
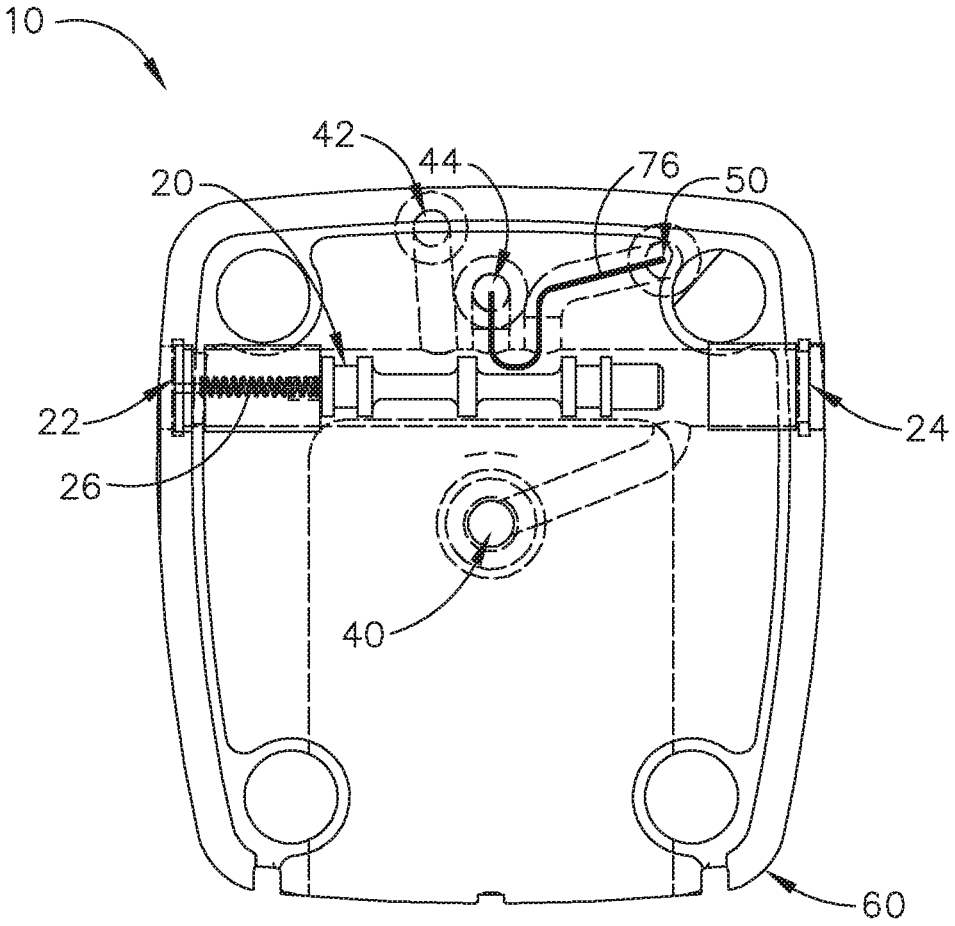
FIG. 7 is a top view of the adapter of FIG. 1, showing a third operating state after the tool's firing valve has operated, the spring has been compressed, and the firing valve will close.

Referring now to FIG. 7, the next state of operation is illustrated in which the air coming through the speed control 40 will move the control valve 20 to the other end of the sleeve (to the left in this view, i.e., towards the spring 26, which becomes compressed), which is the control valve's second position. Therefore, the sourced constant air at 50 will pass through the control valve (in the right air passageway 38) towards the firing valve air passageway 44, which will move downwards, and the firing valve will close. This air flow path is referred to as the "air relief flow path" 76, on FIG. 7. In this position the control valve 20 releases the air, and the fastener driving tool will get into a non-firing position (which is a "rest" position).

Figure 8:
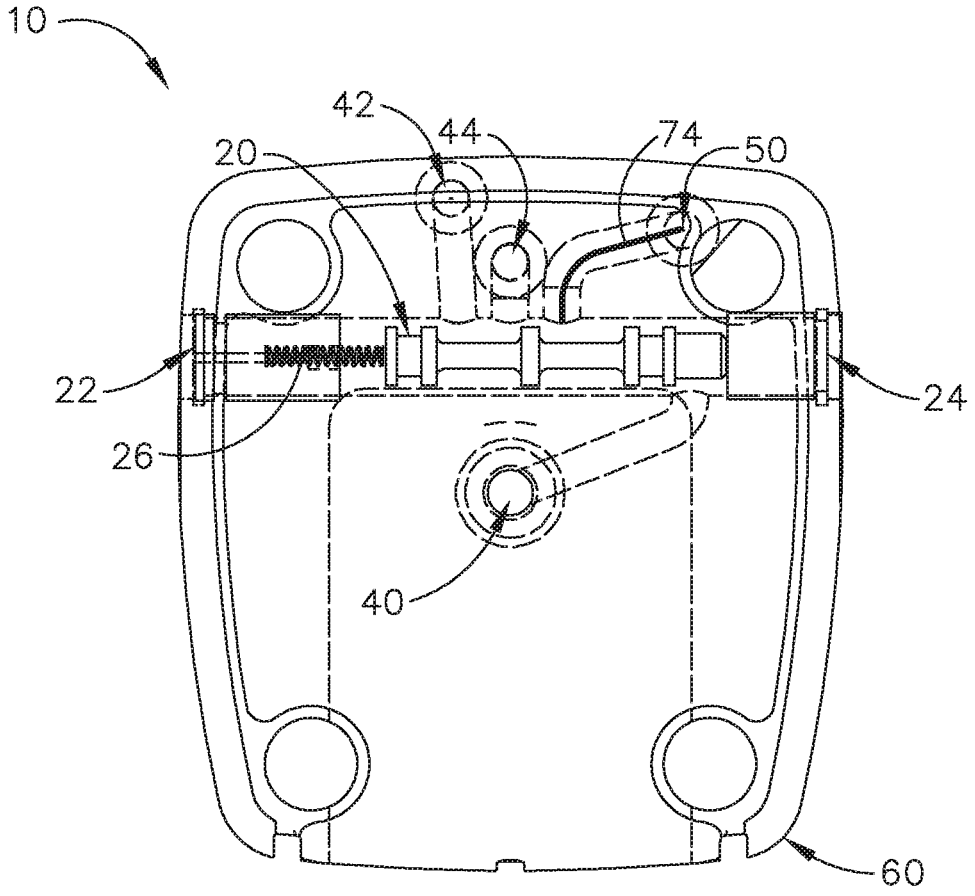
FIG. 8 is a top view of the adapter of FIG. 1, showing a fourth operating state after the spring has pushed the control valve back to its nominal state; the control valve will again function to fire a fastener if the trigger remains actuated.
Figure 9:
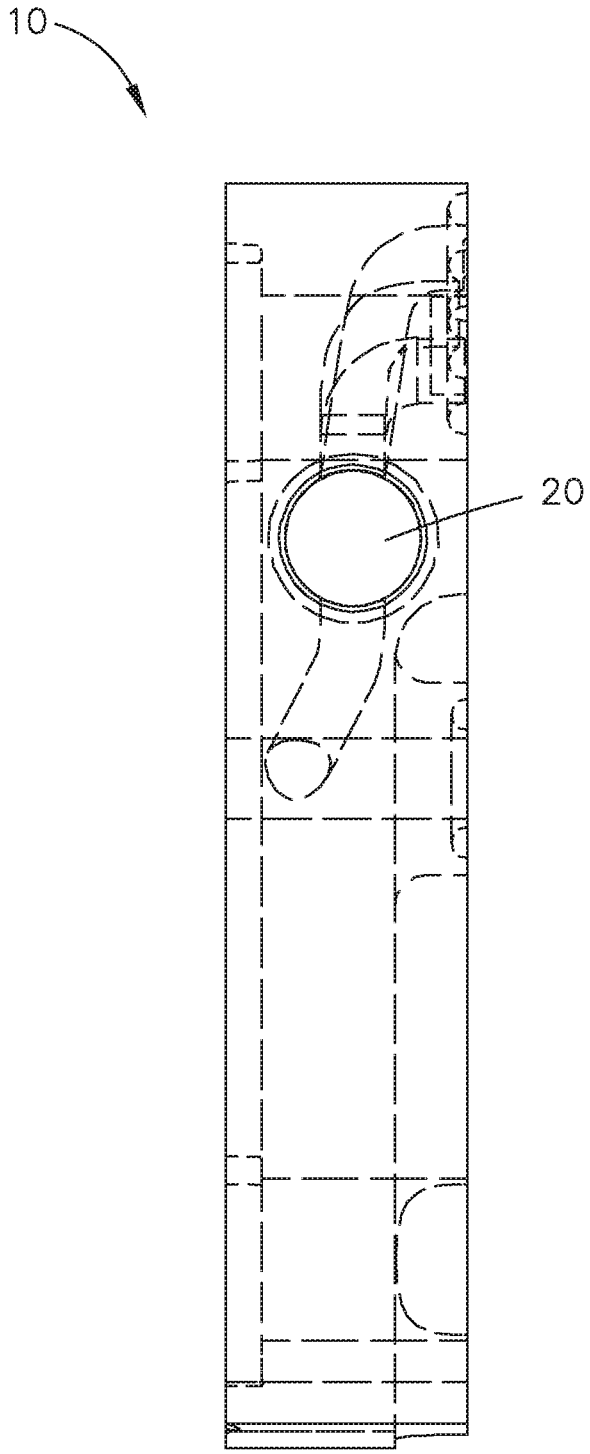
FIG. 9 is a side, elevational view of the adapter of FIG. 1.

Referring now to FIG. 8, the spring 26 will push the control valve 20 back to its nominal (first) position and the tool will again enter the second state, if the trigger remains actuated. But if the trigger is not pressed in, and with the firing valve closed, pressurized air will flow through the air flow path 72, and constant supply air is available at 74. This is the initial state, depicted in FIG. 5; the control valve 20 would remain in its first position until the tool's trigger was once again actuated.

However, if the trigger is still pushed in, then the cycle will continue by automatically entering the second state, as depicted in FIG. 6. As discussed above, pressurized air will then flow through the control valve on the firing valve and is released by the trigger. The firing valve will go up and move to its firing position, and the tool then drives a fastener.

Referring now to FIG. 3, the first view titled "O1" depicts the initial state, which corresponds to that viewed in FIG. 5; pressurized air flows through the flow paths 72 and 74; the trigger is not pulled, and the firing valve is closed. The second view "O2" depicts the second state, which corresponds to that viewed in FIG. 6; pressurized air flows through the flow paths 70 and 74; the trigger is pulled (or "in"), and the firing valve is open. The next view "O3" depicts the third state, which corresponds to that viewed in FIG. 7; pressurized air flows through the flow path 76; the trigger is in, and the firing valve becomes closed. The next view "O4" depicts the fourth state, which corresponds to that viewed in FIG. 8; pressurized air flows through the flow path 74; the trigger remains in, if the user wants to continue to the next automatic firing cycle (i.e., view "O2"). Otherwise, the user releases the trigger, and in that circumstance, the next view "O5" depicts the next state, which is the same as the first state depicted in the view "O1."

The speed of operation for the combination tool 5 and adapter 10 is adjustable, by a slotted type head screw that affects the air flow rate through the speed control air passageway 40. The head screw is retained on top of the adapter 5. The speed control air flow affects how fast the control valve 20 operates. In the illustrated embodiment, the firing valve can cycle at a maximum rate of about 12 times per second.

In an exemplary prototype embodiment, the adapter is about 79 mm×73 mm×15 mm in size. The operating air pressure on the control valve 20 is about 5% of the air pressure of the fastener driving tool 5. In the prototype embodiment, the control valve is made of hardened steel, the spring is made of spring steel, and the material of the control plate 60 is PA2200. The adapter body (i.e., the control plate 60) can be readily manufactured using 3D printing technology.

It will be understood that the precise functions depicted in the drawings, and discussed above, could be somewhat modified to perform similar, although perhaps not exact, functions without departing from the principles of the technology disclosed herein. The exact nature of some of the functions performed by the control scheme described in these drawings are directed toward specific future models of automatic fastener driving tools (those involving Senco fastener driving tools, for example) and certainly similar, but somewhat different, steps would be taken for use with other models or brands of fastener driving tools in many instances, with the overall inventive results being the same.

It will be further understood that any type of product described herein that has moving parts, or that performs functions (such as computers with processing circuits and memory circuits), should be considered a "machine," and not merely as some inanimate apparatus. Such "machine" devices should automatically include power tools, printers, electronic locks, and the like, as those example devices each have certain moving parts. Moreover, a computerized device that performs useful functions should also be considered a machine, and such terminology is often used to describe many such devices; for example, a solid-state telephone answering machine may have no moving parts, yet it is commonly called a "machine" because it performs well-known useful functions.

As used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Or, two or more possible locations for a particular point can be specified in relation to a precise attribute of a physical object, such as being "near" or "at" the end of a stick; all of those possible near/at locations could be deemed "proximal" to the end of that stick. Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

It will be understood that the various components that are described and/or illustrated herein can be fabricated in various ways, including in multiple parts or as a unitary part for each of these components, without departing from the principles of the technology disclosed herein. For example, a component that is included as a recited element of a claim hereinbelow may be fabricated as a unitary part; or that component may be fabricated as a combined structure of several individual parts that are assembled together. But that "multi-part component" will still fall within the scope of the claimed, recited element for infringement purposes of claim interpretation, even if it appears that the claimed, recited element is described and illustrated herein only as a unitary structure.

All documents cited in the Background and in the Detailed Description are, in relevant part, incorporated herein by reference; the citation of any document is not to be construed as an admission that it is prior art with respect to the technology disclosed herein.

The foregoing description of a preferred embodiment has been presented for purposes of illustration and description. It is not intended to be exhaustive or to limit the technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. An adapter for use with a fastener driving tool, comprising:

(a) a housing having a plurality of passageways that allow gas flows to pass therethrough, and including an opening that is in fluidic communication with said plurality of passageways, said opening being sealed by a first bushing proximal to a left end of the opening, and by a second bushing proximal to a right end of the opening;

(b) a control valve that is movable within said opening, said control valve having a left end portion and a right end portion, said control valve including a left land proximal to said left end portion, a right land proximal to said right end portion, and a middle land between said left land and said right land;

(c) said opening including a left gas passageway that exists between said left land and said middle land of the control valve;

(d) said opening including a right gas passageway that exists between said right land and said middle land of the control valve;

(e) a spring that is positioned within the opening, proximal to said left end portion of the control valve;

(f) a first passageway, of said plurality of passageways, that is in fluidic communication with said left gas passageway of the opening;

(g) a second passageway, of said plurality of passageways:

(i) that is in fluidic communication with said left gas passageway of the opening if said control valve resides at a first position that does not compress said spring; and (ii) that is in fluidic communication with said right gas passageway of the opening if said control valve resides at a second position that compresses said spring;

(h) a third passageway, of said plurality of passageways, that is in fluidic communication with said right gas passageway of the opening;

(i) a fourth passageway, of said plurality of passageways, that is in fluidic communication with said right end portion of the control valve; and (j) a head screw that is adjustable to control gas flow through said fourth passageway in order to adjust a rate at which said control valve operates;

wherein, said first, second, third, and fourth passageways of said plurality of passageways are the only passageways that are in fluidic communication with said opening between said first bushing and said second bushing.

2. The adapter of claim 1, wherein: said opening extends at least between said first bushing and said second bushing, said opening having a sufficiently large inner dimension to allow said left land, said middle land, and said right land to slide therewithin as said control valve changes position.

3. The adapter of claim 1, further comprising: a mating surface of said housing, wherein:

(a) said first passageway extends between said opening and said mating surface;

(b) said second passageway extends between said opening and said mating surface;

(c) said third passageway extends between said opening and said mating surface; and (d) said fourth passageway extends between said opening and said mating surface.

4. The adapter of claim 3, wherein: said mating surface comprises an external surface of said housing.

5. The adapter of claim 3, wherein:

(a) said first passageway is of sufficient size and shape to allow pressurized gas to flow between said opening and said mating surface;

(b) said second passageway is of sufficient size and shape to allow pressurized gas to flow between said opening and said mating surface;

(c) said third passageway is of sufficient size and shape to allow pressurized gas to flow between said opening and said mating surface; and (d) said fourth passageway is of sufficient size and shape to allow pressurized gas to flow between said opening and said mating surface.

6. The adapter of claim 1, wherein: said control valve exhibits two operating states:

(a) a first operating state in which the control valve resides at said first position; and (b) a second operating state in which the control valve resides at said second position;

wherein:

(c) if pressurized gas flows through said fourth passageway, it forces said control valve to move toward said second position, while compressing said spring; and (d) if pressurized gas does not flow through said fourth passageway, then said spring forces said control valve to move toward said first position.

7. The adapter of claim 1, wherein: said control valve exhibits two operating states:

(a) a first operating state in which the control valve resides at said first position; and (b) a second operating state in which the control valve resides at said second position;

wherein:

(c) if pressurized gas is present in said fourth passageway, it forces said control valve to move toward said second position, while compressing said spring; and (d) if pressurized gas is not present in said fourth passageway, then said spring forces said control valve to move toward said first position.

8. An adapter for use with a fastener driving tool, comprising:

(a) a housing having a plurality of passageways that allow gas flows to pass therethrough, and including a sleeve that is in fluidic communication with said plurality of passageways, said sleeve being sealed by a first bushing proximal to a left end of the sleeve, and by a second bushing proximal to a right end of the sleeve;

(b) a control valve that is movable within said sleeve, said control valve having a left end portion and a right end portion, said control valve including a left land proximal to said left end portion, a right land proximal to said right end portion, and a middle land between said left land and said right land;

(c) said sleeve including a left gas passageway that exists between said left land and said middle land of the control valve;

(d) said sleeve including a right gas passageway that exists between said right land and said middle land of the control valve;

(e) a spring that is positioned within the sleeve, proximal to said left end portion of the control valve;

(f) a first passageway, of said plurality of passageways, that is in fluidic communication with said left gas passageway of the sleeve;

(g) a second passageway, of said plurality of passageways:

(i) that is in fluidic communication with said left gas passageway of the sleeve if said control valve resides at a first position that does not compress said spring; and (ii) that is in fluidic communication with said right gas passageway of the sleeve if said control valve resides at a second position that compresses said spring;

(h) a third passageway, of said plurality of passageways, that is in fluidic communication with said right gas passageway of the sleeve; and (i) a fourth passageway, of said plurality of passageways, that is in fluidic communication with said right end portion of the control valve;

(j) a head screw that is adjustable to control gas flow through said fourth passageway in order to adjust a rate at which said control valve operates;

wherein, said first, second, third, and fourth passageways of said plurality of passageways are the only passageways that are in fluidic communication with said sleeve between said first bushing and said second bushing.

9. The adapter of claim 8, wherein: said sleeve comprises an opening that extends at least between said first bushing and said second bushing, said opening having a sufficiently large inner dimension to allow said left land, said middle land, and said right land to slide therewithin as said control valve changes position.

10. The adapter of claim 8, further comprising: a mating surface of said housing, wherein:

(a) said first passageway extends between said sleeve and said mating surface;

(b) said second passageway extends between said sleeve and said mating surface;

(c) said third passageway extends between said sleeve and said mating surface; and (d) said fourth passageway extends between said sleeve and said mating surface.

11. The adapter of claim 10, wherein: said mating surface comprises an external surface of said housing.

12. The adapter of claim 10, wherein:

(a) said first passageway is of sufficient size and shape to allow pressurized gas to flow between said sleeve and said mating surface;

(b) said second passageway is of sufficient size and shape to allow pressurized gas to flow between said sleeve and said mating surface;

(c) said third passageway is of sufficient size and shape to allow pressurized gas to flow between said sleeve and said mating surface; and (d) said fourth passageway is of sufficient size and shape to allow pressurized gas to flow between said sleeve and said mating surface.

13. The adapter of claim 8, wherein: said control valve exhibits two operating states:

(a) a first operating state in which the control valve resides at said first position; and (b) a second operating state in which the control valve resides at said second position;

wherein:

(c) if pressurized gas flows through said fourth passageway, it forces said control valve to move toward said second position, while compressing said spring; and (d) if pressurized gas does not flow through said fourth passageway, then said spring forces said control valve to move toward said first position.

14. The adapter of claim 8, wherein: said control valve exhibits two operating states:

(a) a first operating state in which the control valve resides at said first position; and (b) a second operating state in which the control valve resides at said second position;

wherein:

(c) if pressurized gas is present in said fourth passageway, it forces said control valve to move toward said second position, while compressing said spring; and (d) if pressurized gas is not present in said fourth passageway, then said spring forces said control valve to move toward said first position.

15. An adapter, configured to be mounted to a single shot fastener driving tool, that converts the single shot fastener driving tool to an automatic multiple shot fastener driving tool, comprising:

(a) a housing having a plurality of passageways that allow gas flows to pass therethrough, and including an opening that is in fluidic communication with said plurality of passageways, said opening being sealed by a first bushing proximal to a left end of the opening, and by a second bushing proximal to a right end of the opening;

(b) a control valve that is movable within said opening, said control valve having a left end portion and a right end portion, said control valve including a left land proximal to said left end portion, a right land proximal to said right end portion, and a middle land between said left land and said right land;

(c) said opening including a left gas passageway that exists between said left land and said middle land of the control valve;

(d) said opening including a right gas passageway that exists between said right land and said middle land of the control valve;

(e) a spring that is positioned within the opening, proximal to said left end portion of the control valve;

(f) a first passageway, of said plurality of passageways:

(i) that is in fluidic communication with said left gas passageway of the opening; and (ii) that is configured to be placed in fluidic communication with a trigger of said tool;

(g) a second passageway, of said plurality of passageways:

(i) that is configured to supply gas flow to a firing valve of said tool;

(ii) that is in fluidic communication with said left gas passageway of the opening if said control valve resides at a first position that does not compress said spring; and (iii) that is in fluidic communication with said right gas passageway of the opening if said control valve resides at a second position that compresses said spring;

(h) a third passageway, of said plurality of passageways:

(i) that is in fluidic communication with said right gas passageway of the opening; and (ii) that is configured to receive gas flow from a source of gas;

(i) a fourth passageway, of said plurality of passageways, that is in fluidic communication with said right end portion of the control valve; and (j) a head screw that is adjustable to control gas flow through said fourth passageway in order to adjust a rate at which said control valve operates.

16. The adapter of claim 15, wherein:

said housing comprises a rectangular body, and said opening extends through the entire width of said rectangular body in a left-right direction.

17. The adapter of claim 15, wherein: said control valve exhibits two operating states:

(a) a first operating state in which the control valve resides at said first position; and (b) a second operating state in which the control valve resides at said second position;

wherein:

(c) if pressurized gas flows through said fourth passageway, it forces said control valve to move toward said second position, while compressing said spring; and (d) if pressurized gas does not flow through said fourth passageway, then said spring forces said control valve to move toward said first position.

18. The adapter of claim 15, wherein: said control valve exhibits two operating states:

(a) a first operating state in which the control valve resides at said first position; and (b) a second operating state in which the control valve resides at said second position;

wherein:

(c) if pressurized gas is present in said fourth passageway, it forces said control valve to move toward said second position, while compressing said spring; and (d) if pressurized gas is not present in said fourth passageway, then said spring forces said control valve to move toward said first position.

* * * * *